US005679039A

United States Patent [19]

Robles

[11] Patent Number: 5,679,039

[45] Date of Patent: Oct. 21, 1997

[54] SHOCK ABSORBING BINDING

[75] Inventor: Carlos Robles, Olympia, Wash.

[73] Assignee: H.O. Sports, Inc., Redmond, Wash.

[21] Appl. No.: 641,111

[22] Filed: Apr. 29, 1996

Related U.S. Application Data

[63] Continuation of Ser. No. 294,631, Aug. 23, 1994, Pat. No. 5,512,000.

[51] Int. Cl.[6] ..... A63C 9/00

[52] U.S. Cl. ..... 441/70; 280/607

[58] Field of Search ..... 441/65, 70, 75; 114/39.2; 280/602, 607, 617, 618

[56] References Cited

U.S. PATENT DOCUMENTS

| | | | |
|---|---|---|---|
| 2,350,130 | 5/1944 | Rinkinen | 280/607 |
| 3,119,130 | 1/1964 | Senne et al. | 441/70 |
| 4,389,200 | 6/1983 | O'Brien | 441/70 |
| 4,871,337 | 10/1989 | Harris | 441/70 |
| 4,896,895 | 1/1990 | Bettosini | 280/607 |
| 5,242,188 | 9/1993 | Bigler et al. | 280/607 |

FOREIGN PATENT DOCUMENTS

| | | | |
|---|---|---|---|
| 574640 A1 | 12/1993 | European Pat. Off. | 280/607 |

OTHER PUBLICATIONS

HO Sports Incorporated 1993 Brochure, pp. 8 & 10.

HO Extreme Ski Co. 1994 Brochure, pp. 8–9.

*Primary Examiner*—Sherman Basinger
*Attorney, Agent, or Firm*—Seed and Berry LLP

[57] ABSTRACT

A binding assembly for use with a recreation sport board, such as a ski-board, snow-board, or the like, wherein the binding assembly includes a binding having first and second mounting portions and a foot support extending therebetween. The first and second mounting portions being mountable at a first height relative to a top board surface of the board. The foot support has an elevated support plate that is supported by the first and second mounting portions at a second height relative to the top board surface. The second height is greater than the first height to define a tunnel under the elevated support portion. The elevated support portion securely supports the user's foot above the top board surface and moves toward the top board surface when an impact or shock load is exerted on the board, thereby dissipating shock exerted on the user's foot by the binding. A foot pad is adhered atop the elevated support portion and a foot retainer is connected to the binding to retain the user's foot on the foot pad while the sport board is being used.

29 Claims, 2 Drawing Sheets

SHOCK ABSORBING BINDING

CROSS-REFERENCE TO RELATED APPLICATION

This application is a continuation of U.S. patent application Ser. No. 08/294,631, filed Aug. 23, 1994 now U.S. Pat. No. 5,512,000.

TECHNICAL FIELD

The present invention is directed toward equipment for water and snow sports, and more particularly toward recreation sport boards for use on water or snow.

BACKGROUND OF THE INVENTION

A wide variety of recreation sport boards have been developed for water and snow sports. These recreation sport boards include, for example, water skis, waterski-boards or wake-boards, sail-boards, snow-boards and snow skis. A recreation sport board has binding assemblies mounted to a top surface of the board to retain the feet of a user on the board during normal, intended use. During use the board and binding assemblies are subject to impact forces generated by hitting or landing on bumpy water or snow, and these impact forces are transmitted through the binding assemblies to the feet of the user. At advanced skill levels, very high impact forces are experienced by the athlete in the heels and lower legs when traveling over bumpy water or snow at high speeds, or when landing on the water or snow after performing a high-elevation aerial maneuver. The high impact loads to the heels and lower legs cause heel shock, and repetitious heel shock can fatigue the user and make the ride less enjoyable.

A conventional binding assembly that is mounted to, for example, a waterski-board has a flat, rigid mounting plate that is securely fastened to the top surface of the board, referred to as the top board surface, and the athlete's foot is securely retained atop the rigid mounting plate by retaining straps or the like. Heel shock is somewhat reduced by providing a resilient foot pad atop the rigid mounting plate and on which the users foot is placed so as to partially absorb the impact forces transmitted from the board to the binding assembly. The binding assembly further reduces heel shock with a thin layer of impact-absorbing foam that is adhered to the bottom of the rigid mounting plate, such that the foam layer is sandwiched between the rigid mounting plate and the top board surface. This thin foam layer also protects the top surface of the board from being damaged by the rigid mounting plate.

Although the shock from the impact forces transmitted to the user's feet could be greatly reduced by providing a large mount of resilient material between the user's foot and the rigid mounting plate, or between the rigid mounting plate and the board, a significant trade-off occurs between shock attenuation and edge control of the board. When more resilient material is used for increase shock attenuation, edge control is decreased because forces generated by user's foot and leg compress the resilient material and the forces are greatly absorbed before being transmitted to the board. Accordingly, increased edge control from the conventional binding assemblies require less resilient material under the athlete's foot.

In addition, the foam layer between the rigid mounting plate and the board must be relatively thin to minimize lateral movement of the rigid mounting plate relative to the top board surface and to efficiently transmit user applied forces to the board needed for edge control. Thus, conventional binding assemblies result in a tradeoff between edge control and shock absolution.

Accordingly, heretofore there has not been a binding assembly that provides sufficient shock absorption while enhancing rather than reducing edge control of the recreation sport board.

SUMMARY OF THE INVENTION

The present invention provides a binding assembly mountable on a recreation sport board for retaining a foot of a user thereon and reducing transmitted impact loads from the board to the user's foot without sacrificing edge control of the board. In one embodiment of the invention, the binding assembly has a binding with a mounting portion and a foot support portion, and the mounting portion securely mounts to the top board surface with the mounting portion being at a first height relative to the top board surface. The foot support has an elevated support portion that is securely supported by the mounting portion at a second height relative to the top board surface, with the second height being greater than the first height to define a space between the elevated support portion and the top board surface.

The elevated support portion is shaped and sized to support at least a portion of the user's foot, and the foot support is adapted to allow the elevated support portion to move toward the top board surface to dissipate the impact loads exerted on the user's foot by the elevated support portion. A foot retainer securely retains the user's foot atop the elevated support portion.

In a preferred embodiment of the invention, the foot support extends between first and second mounting portions that are releasably secured to the top board surface such that the angular orientation of the binding assembly relative to the top board surface can be adjusted. The mounting portion of the binding assembly is supported at the first height by a foam layer positioned between the first and second mounting portions and the top board surface. A shock absorbent foot pad is attached atop the elevated support portion. The space is located under the elevated support portion and between the first and second mounting portions.

DETAILED DESCRIPTION OF THE INVENTION

Figure 1:
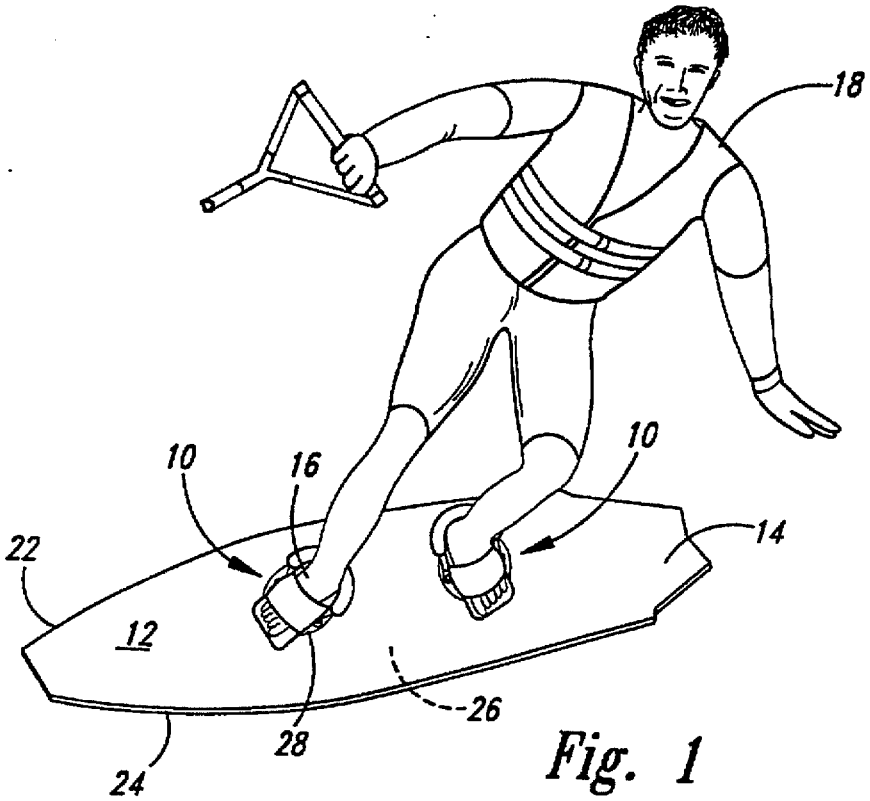
FIG. 1 is an isometric view of two binding assemblies in accordance with the present invention mounted on a waterski-board and a user retained by the two binding assemblies.

Forward and rear binding assemblies 10 in accordance with the present invention are shown in FIG. 1 mounted to a top board surface 12 of a waterski-board 14. The binding assemblies 10 each retain one foot 16 of a waterski-boarder 18 and securely retain the waterski-boarder on the waterski-board. The waterski-board 14 includes left and right edges 22 and 24, respectively, and a bottom surface 26 opposite the top board surface 12, which extends between the left and right edges. The bottom surface 26 is adapted to slide over the surface of water.

The waterski-boarder 18 controls the waterski-board 14, in part, by generating steering forces that are transmitted from the waterski-boarder's feet 16, through the binding assemblies 10, and to the left or right edges 22 and 24 of the waterski-board 14. As is discussed in detail below, the binding assemblies 10 efficiently transmit the steering forces to the waterski-board 14 so as to maximize edge control of the waterski-board as it moves over and through the water. Although the illustrated embodiment of the binding assemblies 10 are shown on a water ski-board 14, the binding assemblies can be used with other recreation sport boards such as snow-boards, sail boards, or the like for sliding over snow, water, or other selected media.

Figure 2:
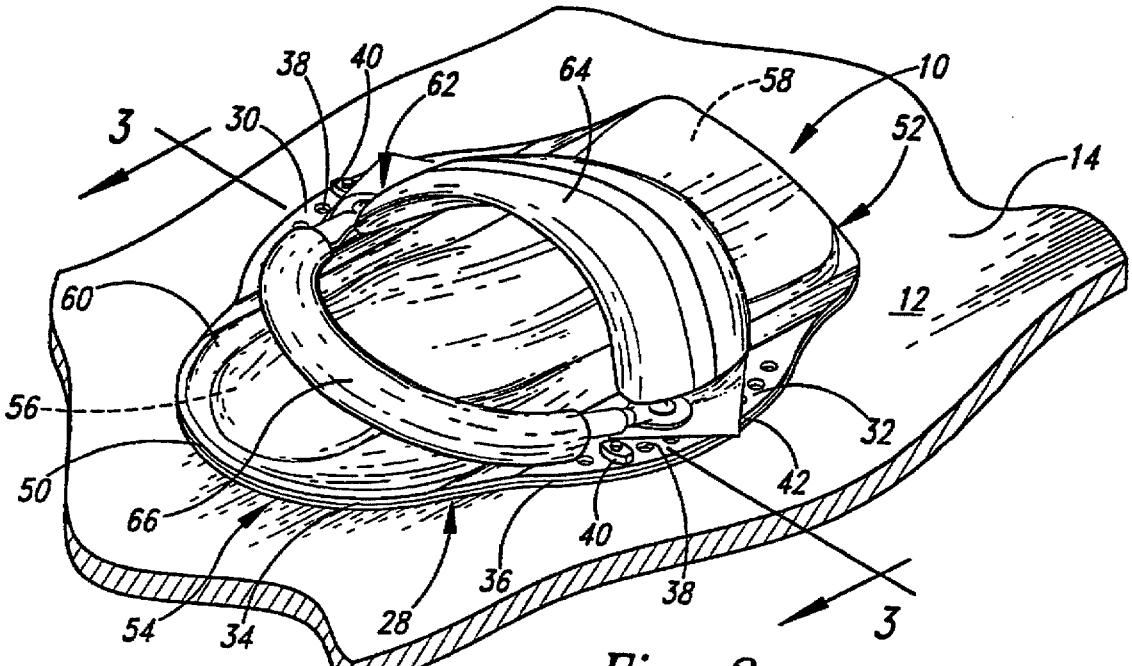
FIG. 2 is an enlarged, fragmentary rear isometric view of one of the binding assemblies of FIG. 1 on the waterski-board.
Figure 3:
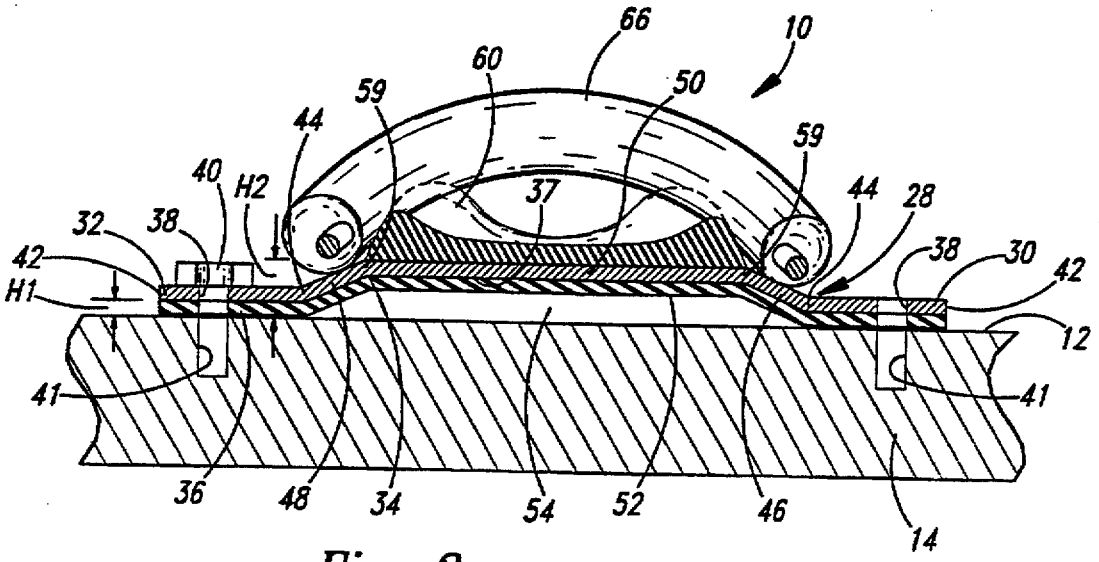
FIG. 3 is an enlarged cross-sectional view taken substantially along the line 3—3 of FIG. 2 showing an elevated support portion positioned above the top surface of the waterski-board.

As best seen in FIGS. 2–3, the binding assembly 10 has a contoured binding 28 with left and right mounting plates 30 and 32, respectively, and a foot support 34 extending therebetween. The left and right mounting plates 30 and 32 are adjustably and rigidly secured to the top board surface 12 of the waterski-board 14. Each of the left and right mounting plates 30 and 32 are flat, rigid, metal members that lie in a first plane parallel to the top board surface 12 and at a first height H1 (FIG. 3) above the top board surface.

In the illustrated embodiment, the left and right mounting plates 30 and 32 are supported at the first height H1 by a thin foam layer 36 that is adhered to a bottom surface 37 of the binding 28. The thin foam layer 36 is sandwiched between the top board surface 12 and the left and right mounting plates 30 and 32 so as to protect the top board surface from being damaged or excessively worn by the rigid mounting plates. The thin foam layer 36 engages the top board surface 12 and resists rotational movement of the binding 28 on the top board surface. The thin foam layer 36 also provides some impact and shock absorption to attenuate shock transmitted from the waterski-board 14 to the waterski-boarder's foot. However, the thickness of the foam layer 36 is minimized in order to maintain an efficient transfer of steering forces from the binding assembly 10 to the waterski-board 14.

Although the illustrated embodiment includes the thin foam layer 36, a binding assembly 10 does not require the foam layer under the mounting plates 30 and 32. When the foam layer 36 is not used, the left and right mounting plates 30 and 32 set directly onto the top board surface 12 and the first height H1 corresponds to the top board surface and is 0 inches.

A plurality of apertures 38 are formed in the left and right mounting plates 30 and 32 and are sized to receive a conventional, hand-removable winged screw fastener 40 that engages a threaded recess portion 41 of the waterski-board 14. The fasteners 40 hold the left and right mounting plates 30 and 32 in a fixed position relative to the top board surface 12 during use of the waterski-board 14. Thus, the fasteners 40 prevent the left and right mounting plates 30 and 32 from moving relative to the top board surface 12 so that steering forces transmitted to the left or right mounting plate are in turn directly transmitted to the waterski-board 14.

The apertures 38 are arranged on the left and right mounting plates 30 and 32 along a circular arc such that each aperture is equidistant from a center point located in the first plane and between the left and right mounting plates. This arrangement of apertures 38 allows the binding 28 to be positioned in a selected one of a plurality of angular orientations relative to the waterski-board 14 in order to accommodate a desired foot position for a particular waterski-boarder. The arrangement of the apertures 38 requires only one fastener 40 for each of the left and right mounting plates 30 and 32 to releasably, yet rigidly, secure the binding assembly 10 to the top board surface 12, such that the angular orientation of the binding assembly 10 can be changed quickly and easily without tools.

As best seen in FIG. 3, each of the left and right mounting plates 30 and 32 extends inwardly toward each other from outer edges 42 and is fixedly connected to the foot support 34 along lower edge portions 44 of substantially in compressible left and right side panels 46 and 48, respectively. The foot support 34 includes the left and right side panels 46 and 48 and an elevated support plate 50 extending therebetween. The left and right side panels 46 and 48 extend inwardly and upwardly away from the respective left and right mounting plates 30 and 32 and the top board surface 12, and connect to the elevated support plate 50. The elevated support plate 50 is adapted to support at least a portion of the waterski-boarder's foot, not shown in FIG. 2, above the top board surface 12. The elevated support plate 50 is supported by the left and right mounting plates 30 and 32 and the left and right side panels 46 and 48 at a second height H2 (FIG. 3) above the top board surface 12 that is greater that the first height, thereby forming a tunnel 52 that defines an open space 54 between the elevated support plate and the top board surface. In the illustrated embodiment, the elevated support plate 50 supports the entire waterski-boarder's foot and the tunnel 52 runs the entire length of the foot support 34.

The illustrated elevated support plate 50 is an elongated plate with heel and toe portions 56 and 58, respectively (see FIG. 2). The heel portion 56 is positioned to support the heel of the waterski-boarder's foot above the tunnel 52, and the toe portion 58 is positioned to support the ball and toes of the waterski-boarder's foot above the tunnel. The tunnel 52 has an open end adjacent to the heel portion 56. As noted above, in the illustrated embodiment the elevated support plate 50 supports both the heel and toe portions 56 and 58 at the second height. The foot support 34 is constructed of a substantially rigid aluminum plate that has a sufficient strength to support the waterski-boarder 18, shown in FIG. 1, thereon without moving from the second height. When the waterski-board 14 is subjected to a large impact load, such as when the waterski-board lands after the waterski-boarder performs a high elevation aerial maneuver, and a large impact is transmitted to the binding assembly 10, the foot support 34 flexes so that the elevated support plate 50 moves into the open space 54 and toward the top board surface 12. Thus, the open space 54 allows for unobstructed movement of the elevated support plate 50 relative to the top board surface 12 to maximize absorption of the impact loads.

This flexing of the elevated support plate 50 absorbs large portions of the impact forces, thereby dissipating shock that is transmitted through the elevated support plate and exerted on the waterski-boarder's foot. Accordingly, the foot support 34 greatly reduces shock experience by the waterski-boarder.

In an alternate embodiment not illustrated, the foot support 34 is shaped such that the tunnel 52 extends forwardly from under the heel portion 56 of the elevated support plate 50 and terminates rearwardly of the toe portion 58. Accordingly, the runnel 52 does not extend under the entire foot and is only provided under the heel portion. As such, the attenuation of impact forces is maximized only at the heel portion to reduce heel shock.

In the illustrated embodiment, the left and right side panels 46 and 48 of the foot support 34 are fixedly connected along their top edge portions 59 to the elevated support plate 50. As noted above, the left and right side panels 46 and 48 are fixedly connected along their lower edge portions 44 to the left and right mounting plates 30 and 32. The left and right side panels 46 and 48 prevent the elevated support plate 50 from moving laterally relative to the top board surface 12 but allow it to move toward the top board surface when an impact is encountered.

In the illustrated embodiment, the mounting plates 30 and 32, the side panels 46 and 48, and the elevated support plate 50 of the foot support 34 are formed as an integral unit from a single piece of contoured 5052 H38 aluminum of about 0.080 inches in thickness with a clear anodized coating thereon. Lateral forces exerted on the elevated support plate 50 from, for example, the waterski-boarder's foot for edge control are transmitted directly to the left and right mounting plates 30 and 32 and to the waterski-board 14. As a result, the binding assembly 10 provides good edge control in conjunction with high impact absorption.

As shown in FIG. 3, the left and right side panels 46 and 48 slope inwardly toward each other as they extend upward toward the elevated support plate 50. These sloped side panels 46 and 48 have sufficient strength to resist movement relative to the top board surface 12 during normal use of the waterski-board. Under conditions of large impact loads, however, the sloped side panels 46 and 48 flex toward each other as the elevated support plate 50 moves toward the top board surface 12, so as to absorb some of the impact load and dissipate the shock loads transmitted to the waterski-boarder's foot. The foot support 34 has sufficient resiliency that the side panels and the elevated support plate 50 return to their original positions once the impact energy has been absorbed.

A conventional contoured foot pad 60 is adhered atop the elevated support plate 50 and extends between the heel and toe portions 56 and 58. The foot pad 60 is contoured to conform to the general shape of the waterski-boarder's foot and provides a cushioning layer on top of the elevated support plate 50 to further help absorb impact forces and to reduce shock transmitted to the waterski-boarder's foot. The contours in the foot pad 60 also assist in keeping the waterski-boarder's foot aligned on the elevated support plate 50 during use of the waterski-board 14. The thickness and rigidity of the foot pad 60 is selected so as to further enhance shock absorption without compromising edge control.

A foot retainer 62 is attached to the binding 28 to releasably retain the waterski-boarder's foot in the binding assembly 10. The foot retainer 62 includes an adjustable length instep strap 64 attached at its opposite ends to the left and right mounting plates 30 and 32. The instep strap extends over the top of the elevated support plate 50 and the foot pad 60. The adjustable instep strap 46 is positioned between the heel and toe portions 56 and 58 of the elevated support plate 50 so as to extend over the instep of a waterski-boarder's foot and securely hold the foot against upward movement away from the foot pad 60. The foot retainer 62 also includes a flexible heel strap 66 attached to the left and right mounting plates 30 and 32. The heel strap extends rearwardly toward the heel portion 56 and over the top of the foot pad 60. The flexible heel strap 66 is shaped to fit across the back of the waterski-boarder's foot and to urge the foot forwardly against the instep strap 64, thereby holding the waterski-boarder's foot in the binding assembly 10.

Although the foot retainer 62 of the illustrated embodiment has the adjustable foot strap 64 and flexible heel strap 66, other foot retention devices, such as the adjustable instep strap without the heel strap, or a conventional water ski boot can be used. In an embodiment wherein the binding assembly 10 is mounted on a snow board or other recreation sport board for use on the snow, the foot retention device can include, for example, straps and buckles that are adapted to hold a snow-boarder's boot on the elevated support platform.

In addition to increasing shock absorption and decreasing heel shock, the binding assembly 10 is configured to increase edge control of the waterski-board 14. The waterski-boarder 18 shown in FIG. 1 controls the waterski-board 14 by tilting the waterski-board with respect to the surface of the water and causing the left or right edge 22 or 24 to partially submerge along its rear half below the water's surface. The left and right edges 22 and 24 are curved so as to facilitate a turn by carving an arc through the water. The waterski-boarder 18 generates steering forces that are transmitted through his feet 16 that, in part, cause the waterski-board 14 to tilt and the left or right edge 22 or 24 to carve, which results in the waterski-boarder having increased control of the waterski-board. Thus, these steering forces generated by the waterski-boarder's feet 16 are transmitted through the binding assembly 10 directly to the left or right edge 22 or 24 of the waterski-board 12 without requiring an excess expenditure of energy by the waterski-boarder to turn the waterski-board.

As best seen in FIG. 3, the elevated support plate 50 of the binding assembly 10 supports the waterski-boarder's foot, not shown, a predetermined and increased distance above the top board surface 12 of the waterski-board 14 than with a conventional binding. The rigidly connected mounting plates 30 and 32 and the foot support 34, along with the foot pad 60, form a substantially rigid lever arm having a length corresponding to the second height of the elevated support plate 50 plus the thickness of the foot pad. This substantially rigid lever arm allows the waterski-boarder to generate a greater amount of force that is efficiently transmitted to the left or right edge 22 or 24 without having to expend excess energy to get the waterski-board to turn. Thus, the foot support 34 having the tunnel 52 thereunder allows the waterski-boarder to maintain enhanced edge control without having to exert an excessive amount of force with his feet and ankles.

While various embodiments have been described in this application for illustrative purposes, the claims are not limited to the embodiments described herein. Equivalent devices may be substituted for those described, which operate according to the principles of the present invention and thus fall within the scope of the claims. Therefore, it is expressly to be understood that modifications and variations may be made to the shock-absorbing binding of the present invention while remaining within the spirit and scope of the invention as defined by the following claims.

I claim:

1. A binding assembly for use with a recreation sport board to retain a foot of a user thereon and reduce transmitted impact loads from the board to the user's foot, the recreation sport board having a top board surface, comprising:

a binding having a mounting portion and a foot support, said mounting portion being rigid and adapted to securely mount to the top board surface, said foot support having an elevated support portion with toe and heel portions and having substantially rigid side portions extending between said toe and heel portions, said side portions connecting said elevated support portion to said mounting portion, said elevated support portion being securely supported by said mounting portion and said side portions in a position spaced away from and above the top board surface at a height relative to the top board surface to define a space between said elevated support portion and the top board surface, said elevated support portion being shaped and sized to support at least a portion of the user's foot, said foot support being adapted to allow said elevated support portion to move toward the top board surface and into said space to dissipate impact loads exerted on the user's foot by said elevated support portion; and a foot retainer to retain the user's foot atop said elevated support portion.

2. The binding assembly of claim 1, wherein said mounting portion and said foot support together define a tunnel below said elevated support portion with said space being open below said toe and heel portions of said elevated support portion so as to allow movement of said elevated support portion toward the top board surface.

3. The binding assembly of claim 1, further comprising a resilient foot pad attached atop said elevated support portion to receive the user's foot thereon.

4. The binding assembly of claim 1, wherein said space is free of obstructions under said elevated support portion so as to provide unobstructed movement of said elevated support portion toward the top board surface.

5. A binding assembly for use with a recreation sport board to retain a foot of a user thereon and reduce transmitted impact loads from the board to the user's foot, the recreation sport board having a top board surface, comprising:

a binding having a mounting portion and a foot support, said mounting portion being adapted to securely mount to the top board surface, said foot support being securely supported by said mounting portion away from the top board surface at an elevated position relative to the top board surface to define a space between said foot support and the top board surface, said foot support having a rear area for supporting the heel of the user's foot and a forward area for supporting the ball of the user's foot, said foot support having substantially rigid side portions attached to said mounting portion and extending between said rear area and said forward area, said space extending forwardly from under said rear area toward said forward area, said foot support having sufficient flexibility to allow said foot support to flex and move toward the top board surface and into said space to dissipate impact loads exerted on the user's foot by said foot support; and a foot retainer to retain the user's foot atop said foot support.

6. The binding assembly of claim 1 wherein the user generates steering forces, and said side portions are connected to said mounting portion and to said elevated support portion with sufficient rigidity to transmit the steering forces from the user's foot through said binding to the board but allow said elevated support portion to move toward the top board surface under impact loads.

7. The binding assembly of claim 5 wherein said foot support is a substantially rigid member having sufficient strength to support the user thereon with said foot support being securely supported at said elevated position during normal use of the board, and said foot support being adapted to move toward the top board surface under impact loads.

8. A recreation sport board assembly for use by a user, comprising:

a recreation sport board having left and right edges and top and bottom board surfaces extending between said left and right edges, said bottom board surface being adapted to slide on a preselected medium and receive and transmit impact loads; and a binding assembly mounted to said top board surface to retain a foot of the user on said board and reduce transmitted impact loads from said board to the user's foot, said binding assembly including:

a binding having a mounting portion and a foot support, said mounting portion being rigid and adapted to securely mount to said top board surface, said foot support having substantially rigid side portions and an elevated support portion with toe and heel portions, said side portions extending between said toe and heel portions, said elevated support portion being securely supported by said side portions and said mounting portion in a position spaced away from and above said top board surface at a height relative to said top board surface to define a space between said elevated support portion and said top board surface, said elevated support portion being shaped and sized to support at least a portion of the user's foot, said foot support being adapted to allow said elevated support portion to flex and move toward said top board surface and into said space to dissipate impact loads exerted on the user's foot by said elevated support portion; and a foot retainer to retain the user's foot atop said elevated support portion.

9. The recreation sport board assembly of claim 8, wherein said space is free of obstructions under said elevated support portion so as to provide unobstructed movement of said elevated support portion toward said top board surface.

10. The recreation sport board assembly of claim 8 further comprising a resilient foot pad attached atop said elevated support portion to receive the user's foot thereon.

11. The recreation sport board assembly of claim 8 wherein the recreation sport board is a waterski-board and said bottom surface being adapted to slide on water.

12. The recreation sport board assembly of claim 8 wherein the recreation sport board is a snow-board and said bottom surface being adapted to slide on snow.

13. The recreation sport board of claim 8 wherein said foot support has a longitudinal axis extending between said toe and heel portions and said heel portion is free of obstructions thereunder along said longitudinal axis for unobstructed movement of said heel portion toward said top board surface.

14. The binding assembly of claim 1 wherein said foot support has a longitudinal axis extending between said toe and heel portions and said heel portion is free of obstructions thereunder along said longitudinal axis for unobstructed movement of said heel portion toward the top board surface.

15. The binding assembly of claim 1 wherein the side portions are substantially rigid side portions terminating at a forward end adjacent to said toe portion and terminating at a rearward end adjacent to said heel portion.

16. The binding assembly of claim 1 wherein said side portions are substantially rigid side portions integrally connected to said elevated support portion.

17. A binding assembly for use with a recreation sport board to retain a foot of a user thereon and reduce transmitted impact loads from the board to the user's foot, the recreation sport board having a top board surface, comprising:

a binding having a mounting portion and a foot support, said mounting portion being adapted to securely mount to the top board surface, said foot support having an elevated support portion with toe and heel portions and having substantially incompressible side portions extending between said toe and heel portions, said side portions connecting said elevated support portion to said mounting portion, said elevated support portion being shaped and sized to support at least a portion of the user's foot, said foot support and mounting portion defining a tunnel extending below said elevated support portion between said toe and heel portions, said elevated support portion being substantially rigid with sufficient strength to support the user thereon during normal use of the board, and being sufficiently flexible to flex under impact loads exerted on the user's foot by said elevated support portion, said elevated support portion being securely supported by said mounting portion and said side portions in a position spaced away from and above the top board surface sufficient to define a space between said elevated support portion and the top board surface, and to allow said elevated support portion to flex and move toward the top board surface and into said space to dissipate impact loads exerted on the user's foot by said elevated support portion; and a foot retainer to retain the user's foot atop said elevated support portion.

18. The binding assembly of claim 17, wherein said space is open below said toe and heel portions of said elevated support portion so as to allow movement of said elevated support portion toward the top board surface.

19. The binding assembly of claim 18 wherein said tunnel extends below and fully between said toe and heel portions.

20. The binding assembly of claim 19 wherein said tunnel has an open end adjacent to said heel portion.

21. A binding assembly for use with a recreation sport board to retain a foot of a user thereon and reduce transmitted impact loads from the board to the user's foot, the recreation sport board having a top board surface, comprising:

a binding having a mounting portion and a foot support, said mounting portion being adapted to securely mount to the top board surface, said foot support having an elevated support portion with toe and heel portions and having substantially incompressible side portions extending between said toe and heel portions, said side portions connecting said elevated support portion to said mounting portion, said elevated support portion being shaped and sized to support at least a portion of the user's foot, said foot support and mounting portion defining a tunnel extending below said elevated support portion between said toe and heel portions, said elevated support portion being substantially rigid with sufficient strength to support the user thereon during normal use of the board, and being sufficiently flexible to flex under impact loads exerted on the user's foot by said elevated support portion, said elevated support portion being securely supported by said mounting portion and said side portions in a position spaced away from and above the top board surface sufficient to allow said elevated support portion to flex and move toward the top board surface to dissipate impact loads exerted on the user's foot by said elevated support portion; and a foot retainer to retain the user's foot atop said elevated support portion.

22. The binding assembly of claim 21, wherein said tunnel below said elevated support portion is open below said toe and heel portions of said elevated support portion so as to allow movement of said elevated support portion toward the top board surface.

23. The binding assembly of claim 1 wherein said side portions are substantially incompressible.

24. The binding assembly of claim 17 wherein said substantially incompressible side portions are substantially rigid.

25. The binding assembly of claim 21 wherein said substantially incompressible side portions are substantially rigid.

26. A binding assembly for use with a recreation sport board to retain a foot of a user thereof and reduce transmitted impact loads from the board to the user's foot, the recreation sport board having a top board surface, comprising:

a binding having a side support and an elevated foot support, said elevated foot support having toe and heel portions and being shaped and sized to support at least a portion of the user's foot, said elevated foot support being substantially rigid with sufficient strength to support the user thereon during normal use of the board, and being sufficiently flexible to flex under impact loads exerted on the user's foot by said elevated foot support, said side support being adapted to securely mount to the top board surface, said side support being substantially incompressible and at a position between said toe and heel portions securely supporting said elevated foot support in a position spaced away from and above the top board surface sufficient to define a space between said elevated foot support and the top board surface and to allow said elevated foot support to flex and move toward the top board surface and into said space to dissipate impact loads exerted on the user's foot by said elevated support portion; and a foot retainer to retain the user's foot atop said elevated support portion.

27. The binding assembly of claim 26 wherein said side support extends fully between said toe and heel portions of said elevated foot support.

28. The binding assembly of claim 26 wherein said side support has a mounting portion adapted to securely mount to the top board surface and a side portion extending between said mounting portion and said elevated foot support.

29. The binding assembly of claim 26 wherein said side portion is substantially rigid.

a foot retainer to retain the user's foot atop said elevated support portion.

* * * * *

UNITED STATES PATENT AND TRADEMARK OFFICE

CERTIFICATE OF CORRECTION

PATENT NO. : 5,679,039
DATED : October 21, 1997
INVENTOR(S) : Carlos Robles

It is certified that error appears in the above-identified patent and that said Letters Patent is hereby corrected as shown below:

In claim 29, delete lines 55 and 56.

Signed and Sealed this

First Day of December, 1998

*Attest:*

Bruce Lehman

BRUCE LEHMAN

*Attesting Officer*

*Commissioner of Patents and Trademarks*